US010190770B2

(12) United States Patent
Tran et al.

(10) Patent No.: US 10,190,770 B2
(45) Date of Patent: Jan. 29, 2019

(54) METHOD FOR COOLING SOLID RESIDUES OF A COMBUSTION PROCESS

(71) Applicant: HITACHI ZOSEN INOVA AG, Zurich (CH)

(72) Inventors: Nicolas Tran, Zurich (CH); Werner Brennwald, Neftenbach (CH)

(73) Assignee: HITACHI ZOSEN INOVA AG, Zurich (CH)

( * ) Notice: Subject to any disclaimer, the term of this patent is extended or adjusted under 35 U.S.C. 154(b) by 483 days.

(21) Appl. No.: 15/040,806

(22) Filed: Feb. 10, 2016

(65) Prior Publication Data

US 2016/0230990 A1 Aug. 11, 2016

(30) Foreign Application Priority Data

Feb. 10, 2015 (EP) ..... 15000394

(51) Int. Cl.

| | |
|---|---|
| ***F23J 1/02*** | (2006.01) |
| ***F27D 15/02*** | (2006.01) |
| ***F28F 13/02*** | (2006.01) |
| ***F23J 3/00*** | (2006.01) |
| ***F28D 21/00*** | (2006.01) |

(52) U.S. Cl.

CPC . *F23J 1/02* (2013.01); *F23J 3/00* (2013.01); *F27D 15/0213* (2013.01); *F27D 15/0266* (2013.01); *F28F 13/02* (2013.01); *F23J 2900/01002* (2013.01); *F23L 2900/15041* (2013.01); *F28D 2021/0045* (2013.01)

(58) Field of Classification Search

CPC .. F23J 1/02; F23J 3/00; F23J 2700/001; F23J 2900/01002; F27D 15/0266; F28F 13/02; F23L 2900/15041

See application file for complete search history.

(56) References Cited

U.S. PATENT DOCUMENTS

| | | | | |
|---|---|---|---|---|
| 1,844,782 A | 2/1932 | Mittag | | |
| 7,146,915 B2 * | 12/2006 | Magaldi | ..... | F23J 1/02 110/165 R |

FOREIGN PATENT DOCUMENTS

| | | | | |
|---|---|---|---|---|
| DE | 10 2009 060 305 A1 | 6/2011 | | |
| EP | 2 778 523 A1 | 9/2014 | | |
| GB | 823892 A * | 11/1959 | ..... | B65G 37/00 |
| NL | 1 018 683 C2 | 2/2003 | | |
| WO | 87/04231 A1 | 7/1987 | | |
| WO | 2012/098504 A2 | 7/2012 | | |

OTHER PUBLICATIONS

Aug. 3, 2015 Extended Search Report issued in European Patent Application No. 15000394.5.

* cited by examiner

*Primary Examiner* — David J Laux

(74) *Attorney, Agent, or Firm* — Oliff PLC

(57) ABSTRACT

A method for cooling solid residues of a combustion process, which are deposited onto the conveying surface of a conveyor belt of a conveying device and are conveyed in the direction of a solid residue outlet, wherein during conveying heat is transferred from the solid residues to a gaseous coolant. The method is characterized in that the conveyor belt is acted upon by coolant only on its side oriented away from the conveying surface, the conveyor belt is essentially impermeable to the coolant and at least part of the coolant heated by contact with the conveyor belt is extracted on that side oriented away from the conveying surface.

13 Claims, 4 Drawing Sheets

METHOD FOR COOLING SOLID RESIDUES OF A COMBUSTION PROCESS

The present invention relates to a method for cooling solid residues of a combustion process according to the preamble of claim 1, and to a conveying device for carrying out this method.

Combustion plants for combusting solid fuels such as domestic waste, substitute fuels, biomass and other materials will be very well known to a person skilled in the art. Plants of this type comprise a combustion chamber in which the solid is combusted with a supply of what is termed primary air. In that context, the solid goes through various partial processes between the inlet into the combustion chamber and the outlet, which can, in broad terms, be split into drying, ignition, combustion and ash burn-out.

In the field of waste combustion, the lumps of solid residue present at the end of the combustion process are known as clinker. A further portion of solid residues can for example exist as fly ash which, essentially, is separated by means of filters in an exhaust gas purification process carried out downstream, as seen in the flow direction of the flue gases.

The clinker is removed from the waste combustion plant by means of a de-clinkering device which generally comprises a chute via which the clinker falls out of the combustion chamber into a trough filled with water. The clinker quenched in this manner is then ejected for example by means of corresponding rams, and is further transported into an intermediate store (bunker or container).

For the purpose of increased value creation of the waste combustion plants, great efforts have been made for some time to recover reusable materials from the clinker. For this recovery, the clinker undergoes suitable separation. However, the most complete possible separation can be carried out only on dry clinker.

Thus, EP-A-2 778 523 for example describes a clinker preparation device for preparing dry clinker from a combustion chamber of a waste combustion plant, which allows the clinker to be separated into at least one dry fine fraction and a coarse fraction.

In order that the dry clinker can be removed as quickly as possible and, where relevant, made available for further processing, it must undergo cooling.

To that end, there is for example conceivable, in principle, a device according to EP-A-0 252 967 which describes a device for the continuous removal of dry bottom ash which comprises a conveyor belt over which there is emitted a quantity of air controlled by a valve in counter-flow to the direction of the ash removal, such that the heat given off to the air is returned to the combustion chamber.

In addition, DE 10 2009 060 305 A1 describes a method in which the hot material is cooled by cooling air flowing over the material and in addition the underside of an upper strand of the conveying means is sprayed with a liquid spraying medium. Spraying the underside of a conveyor belt with water is also taught in NL 1018683.

Due to the gas flow over the ash bed, which is required for the cooling according to EP-A-0 252 967, EP-A-2 665 971 and DE 10 2009 060 305 A1, this involves introducing a relatively large quantity of air into the internal space of the corresponding conveying device. In order to prevent a temperature drop in the combustion chamber that would be detrimental for the burn-out and the energy balance, it must however be ensured that as little cooling air as possible reaches the combustion chamber.

Against this backdrop, EP-A-2 665 971 for example proposes a device for cooling ashes from a combustion chamber, comprising a conveyor belt whose conveying surface is provided with openings in order to allow a flow of air through the conveying surface and through the ash bed. This is intended to permit more efficient cooling with less air.

However, a general drawback of the methods described both in EP-A-0 252 967 and in EP-A-2 665 971 is that of substantial dust formation, which must be countered by means of costly measures. In addition, in both methods an uncontrolled quantity of air enters the combustion chamber, which leads to a temperature drop in the combustion chamber which is detrimental for the energy balance and for the burn-out.

As regards the technology described in DE 10 2009 060 305, further problems arise from the use, recommended therein, of a liquid spraying medium, with respect to possible corrosion of the conveying device or of constituent parts thereof. In addition, on account of using a liquid spraying medium, it is necessary to carry out relatively frequent maintenance work, which also implies operational downtime. Finally, it is to be ensured that a sufficient supply of water is present and that the waste water produced by the method can be treated or disposed of.

The present invention thus has the object of providing a method for cooling solid residues of a combustion process, which makes it possible to cool the solid residues but which is also low-maintenance and contributes to an advantageous energy balance of the combustion plant as a whole. In particular, the abovementioned drawbacks of the prior art, specifically marked dust formation and an energy balance of the combustion plant which is impaired by dead air, are to be avoided.

It is further conceivable to use the represented invention for cooling ashes produced by exhaust gas purification.

The object is achieved according to the invention with the method as claimed in claim 1. Preferred embodiments of the invention are reproduced in the dependent claims.

As claimed in claim 1, the invention thus relates to a method for cooling solid residues of a combustion process, which are deposited onto the conveying surface of a conveyor belt of a conveying device and are conveyed in the direction of a solid residue outlet, wherein during conveying heat is transferred from the solid residues to a gaseous coolant.

According to the invention, the conveyor belt is now acted upon by coolant only on its side oriented away from the conveying surface and is essentially impermeable to the coolant.

Typically, the temperature of the solid residues deposited onto the conveying device is in the range from 200° C. to 500° C., preferably from 200° C. to 300° C.

These solid residues are cooled, while being conveyed to the solid residue outlet, preferably to below 150° C., preferably to below 100° C.

According to the invention, the coolant is gaseous. As is explained below, use is preferably made of air as the coolant. The transfer of heat according to the invention or the cooling, obtained thereby, of the solid particles thus differs fundamentally from technologies in which use is made of a liquid spraying medium which, on account of the other material properties, in particular the greater density, in comparison to a gaseous coolant, can be distributed on the surface to be cooled only very unsatisfactorily with reasonable effort.

According to the invention, at least part of the coolant heated by contact with the conveyor belt is extracted on that side oriented away from the conveying surface. In other words, the heated coolant is drawn out from the space underneath the conveying surface and thus the heat is removed from the system.

The invention is thus based on the conveyor belt serving not only to convey the solid residues in the direction of the solid residue outlet, but also permitting a spatial separation of the solid residues from the coolant or from the cooling system for cooling the solid residues.

This is achieved by the fact that the conveyor belt is essentially impermeable to the coolant and is acted upon by coolant only on its side oriented away from the conveying surface. In other words, coolant circulation which is required for the cooling is brought about only in one space, which is separated from that space in which are arranged the solid residues; the invention thus avoids a coolant-solid mixture.

In contrast to the teaching of EP-A-0 252 967, DE 10 2009 060 305 A1 and EP-A-2 665 971, it has surprisingly been found that sufficient cooling can be achieved by the indirect transfer of heat from the solid residues to the gaseous coolant. It has in particular been found that neither direct contact with the coolant, nor additional use of a liquid spraying medium is required in order to achieve sufficient cooling.

The problem of dust formation—which arises in the methods according to EP-A-0 252 967, DE 10 2009 060 305 A1 and EP-A-2 665 971 and is caused by the fact that air is introduced over the ash bed or through the ash bed and thus, necessarily, an air-solid mixture is produced during the transport of the solid residues—can thus be avoided by means of the invention. Finally, this provides a low-maintenance and simple method for cooling the solid residues, in particular clinker or ash.

By cooling the solid residues indirectly, i.e. without direct contact between the solid residues and the coolant, the invention can moreover ensure that as little dead air as possible reaches the combustion chamber via the cooling system. This makes it possible to better control the quantity of air fed to the combustion chamber for the primary combustion, and thus the temperature in the combustion chamber, which has a positive effect on the energy balance of the combustion plant.

This is also contrary to the constructions according to EP-A-0 252 967, DE 10 2009 060 305 A1 and EP-A-2 665 971, where an uncontrolled quantity of cooling air is introduced into the combustion chamber, which leads to a temperature drop in the combustion chamber which is detrimental for the energy balance and for the burn-out.

For the purpose of an advantageous energy balance of the combustion plant, it is also conceivable, according to another preferred embodiment of the method according to the invention, to use the heated coolant as heating medium after extraction, for heating the air required for the combustion, or to use it in another manner, for example in an adjacent district heating plant or another type of energy recovery plant.

As mentioned above, the coolant is gaseous, in particular air. This makes it possible to effectively prevent potential corrosion problems, as can arise in particular when using water as coolant, it thus being possible to further minimize maintenance expenditure. A water-free cooling method has the additional advantage, specifically in combination with a dry discharge of clinker, that no water treatment costs arise.

According to a particularly preferred embodiment of the invention, only a gaseous coolant is therefore used. In particular, according to this embodiment, no liquid spraying medium is used, which medium is considered to be essential according to the teaching of DE 10 2009 060 305 A1. The problems resulting from the use of a liquid spraying medium, which are also described in DE 10 2009 060 305 A1, that the spraying medium must be captured and cleaned prior to renewed use, thus do not arise according to the invention.

According to one preferred embodiment of the invention, the conveyor belt is acted upon by coolant via gas nozzle openings which are arranged, at least in part, at a distance of less than 30 cm, preferably less than 20 cm and most preferably less than 10 cm from that surface of the conveyor belt which is to be acted upon.

As explained in conjunction with the figures, the outlet openings, via which the coolant is drawn off, can, at least in part, be arranged at a similar distance from that surface of the conveyor belt which is to be acted upon. Thus, according to another preferred embodiment, the outlet openings are arranged at a distance of less than 30 cm, preferably less than 20 cm and most preferably less than 10 cm from that surface of the conveyor belt which is to be acted upon. The result of this is that heated coolant is extracted early, which in the end results in optimized cooling. In particular, this embodiment makes it possible to keep the flow path of the coolant short, which avoids the heated coolant residing for too long in the space on that side of the conveyor belt which is oriented away from the conveying surface, which could thus have a negative effect on the cooling efficiency.

In addition to the described method, the present invention also relates to a conveying device for carrying out the method.

As described in the context of the method, the conveying device comprises a conveyor belt, preferably an endless conveyor belt, with a conveying surface for conveying solid residues, wherein the conveying device additionally has means for cooling the solid residues and these means comprise a coolant supply for introducing a gaseous coolant and a coolant evacuation for extracting at least part of the coolant heated by the solid residues.

The conveyor belt is essentially impermeable to the coolant. In addition, the coolant supply and the coolant evacuation are configured such that the coolant is in contact only with that side of the conveyor belt oriented away from the conveying surface.

In particular, the coolant supply is configured such that the conveyor belt is acted upon with coolant only on that side which is oriented away from the conveying surface.

As explained in particular in conjunction with the figures, the conveying device also generally comprises an elongate housing which, together with the conveyor belt, encloses a space to which the coolant supply and the coolant evacuation are connected.

As is also explained in conjunction with the figures, it is conceivable that the conveying device or the conveying direction F defined thereby runs horizontally in its first section, to which there connects a second section directed diagonally upward, and the solid residues are cooled with coolant in particular in the second section.

According to a particularly preferred embodiment, the conveyor belt is an endless conveyor belt which is guided around at least two rollers and forms a loop with a conveying strand and a return strand. In that context, the solid residues are received on the conveying surface of the conveying strand and are conveyed in the conveying direction F.

In the context of the present invention, the conveying strand is understood to be that side of the conveyor belt which is pulled and is taut, while the loose side of the conveyor belt, which is not pulled, forms the return strand.

Such a construction of the conveyor belt is for example possible with metal plates which extend over the entire width of the conveyor belt and which overlap. For good heat transfer between the solid residues and the coolant, plates made of steel are chosen, for example. The space, through which flows the coolant, under the conveying strand can for example be sealed most efficiently with a constructive configuration of metal sheets which are arranged on the side walls and protrude beyond the edges of the conveying strand such that the gap between these metal sheets and the conveying strand is kept as small as possible and high flow resistance is achieved with this "meshing".

Multiple possibilities exist for the constructive configuration of the coolant supply and evacuation. A simple embodiment comprises a coolant supply distribution pipe which is connected to a coolant compressor and via which the coolant is distributed into coolant supply pipes that each lead, either directly or via a supply coupling pipe, to a corresponding coolant inlet arranged in a side wall of the housing. Via the corresponding side wall, coolant supply nozzle pipes can project into the space under the conveying strand, which pipes have, in their uppermost region, openings via which the coolant is introduced onto that side of the conveyor belt oriented away from the conveying surface.

As far as the coolant evacuation is concerned, it is conceivable to guide the heated coolant, by means of a coolant suction or via coolant outlets in the side wall, either directly or via evacuation coupling pipes, into corresponding coolant evacuation pipes and then to collect this heated coolant in a coolant evacuation collecting pipe.

It is in particular also conceivable to arrange the coolant supply on the same side of the conveying device as the coolant evacuation, or on the respective opposite side. Accordingly, the coolant inlets and the coolant outlets are arranged in the same side wall or in the respective opposite side walls.

According to another embodiment, the space between the conveying strand and the return strand is divided with a wall running essentially parallel to the plane of the conveying strand, so as to form an interspace between the conveying strand and this wall, and so as to assign the coolant supply and the coolant evacuation to this interspace. This arrangement makes it possible to reduce the size of the space through which coolant flows, and thus to reduce the required quantity of coolant.

In addition, according to another embodiment, the space between the conveying strand and the return strand can be divided into at least two compartments in the conveying direction, wherein in each case at least one valve for controlling the quantity of coolant to be introduced is assigned to the coolant supply and/or evacuation assigned to the different compartments or connected to the different compartments. With such a division of the space between the conveying strand and the return strand, it is possible to ensure that the cooling or the introduced quantity of coolant can be adapted locally, as required.

The preferred embodiments described in the context of the method according to the invention represent equally preferred embodiments of the conveying device. Vice versa, all of the preferred features described in the context of the conveying device represent preferred features of the method.

In particular, the conveying device is configured for the use of air as coolant. In a further analogy to the preferred embodiments described for the method, the coolant supply preferably comprises gas nozzles whose openings are arranged at least in part at a distance of less than 30 cm, preferably less than 20 cm and most preferably less than 10 cm from that surface of the conveyor belt which is to be acted upon, in particular the underside of the conveying strand.

As is discussed below in the context of the figures, according to one particularly preferred embodiment the gas nozzles are in the form of coolant supply nozzle pipes. These coolant supply nozzle pipes are connected to the coolant supply pipes and have nozzle pipe openings in their uppermost region.

In this regard, it is further preferred that multiple gas nozzle openings are arranged in a distributed manner over the entire width of the conveyor belt, in order to ensure that coolant acts as evenly as possible also in the width direction. In the event that the gas nozzles are in the form of coolant supply nozzle pipes, these then preferably run in a transverse direction with respect to the conveying direction, that is to say in the width direction of the conveyor belt.

As mentioned, the method and the conveying device of the present invention are particularly relevant to the field of waste combustion, in particular with respect to cooling the clinker resulting at the end of the combustion process in the combustion chamber.

According to another aspect, the present invention thus also relates to a waste combustion plant containing the above-described conveying device.

The invention is further clarified with reference to the appended figures, in which.

Figure 1:
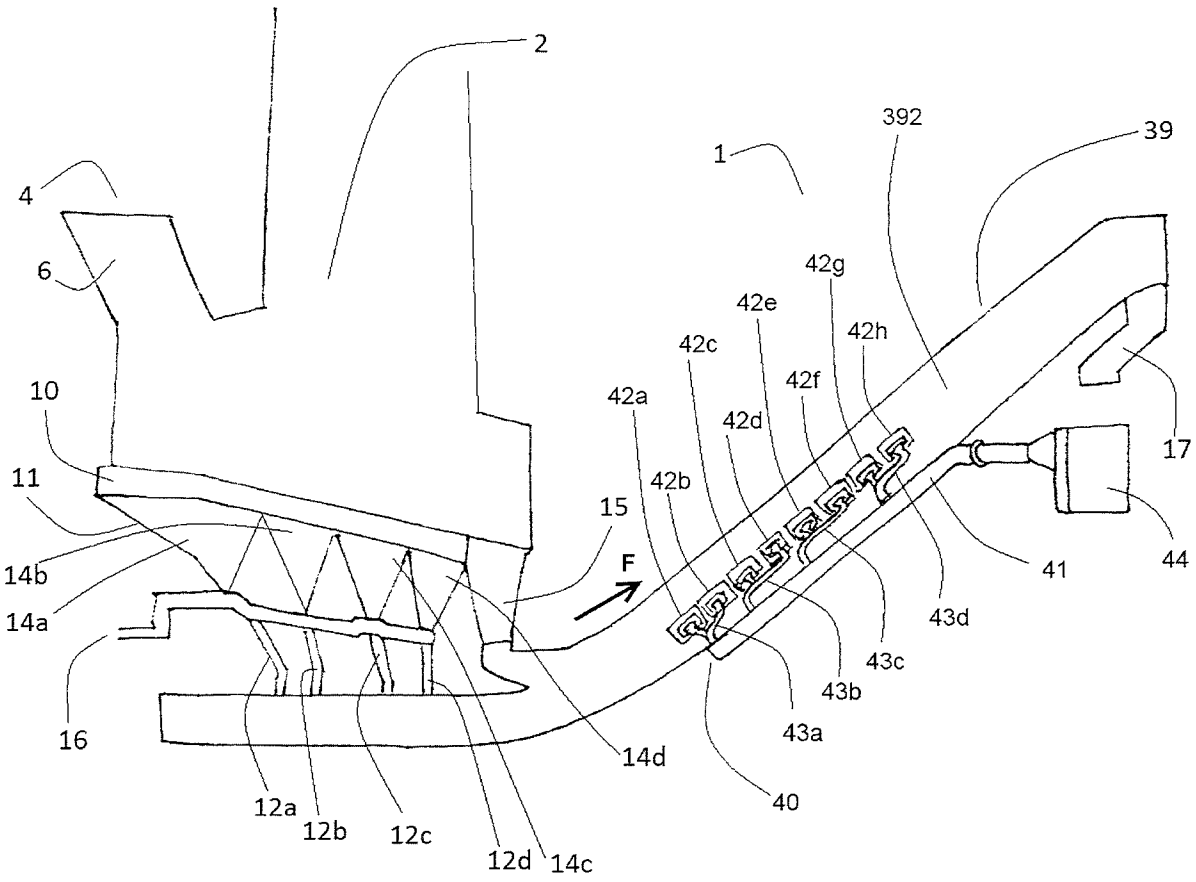
FIG. 1 shows a furnace of a waste combustion plant comprising a combustion chamber, a waste supply, a combustion grate, a coarse clinker discard chute and a conveying device for carrying out the method according to the invention.

As shown in FIG. 1, the waste combustion plant comprises a combustion chamber 2, upstream of which is mounted a waste supply 4 with an adjoining waste chute 6. The combustion chamber 2 comprises a combustion grate 10 which, in the embodiment shown, is divided into four grate sections (not shown) and is supplied with primary air via a primary air supply 11. Specifically, a funnel-shaped under-grate air chamber 14*a*, 14*b*, 14*c*, 14*d* is arranged underneath each of the grate sections, each of which chambers has opening into it a primary air supply line 16 and is designed to supply primary air via corresponding primary air ducts, through the combustion grate 10, to the combustion bed.

The fine clinker components which, due to the construction of the grate, always fall through are discarded via the funnel necks 12*a* to 12*d* of the respective under-grate air chambers 14*a* to 14*d* onto a conveying device 1 which conveys them in the conveying direction F to a solid body outlet 17. The remaining clinker, which comprises larger clinker pieces, arrives at a coarse clinker discard chute 15.

Figure 2:
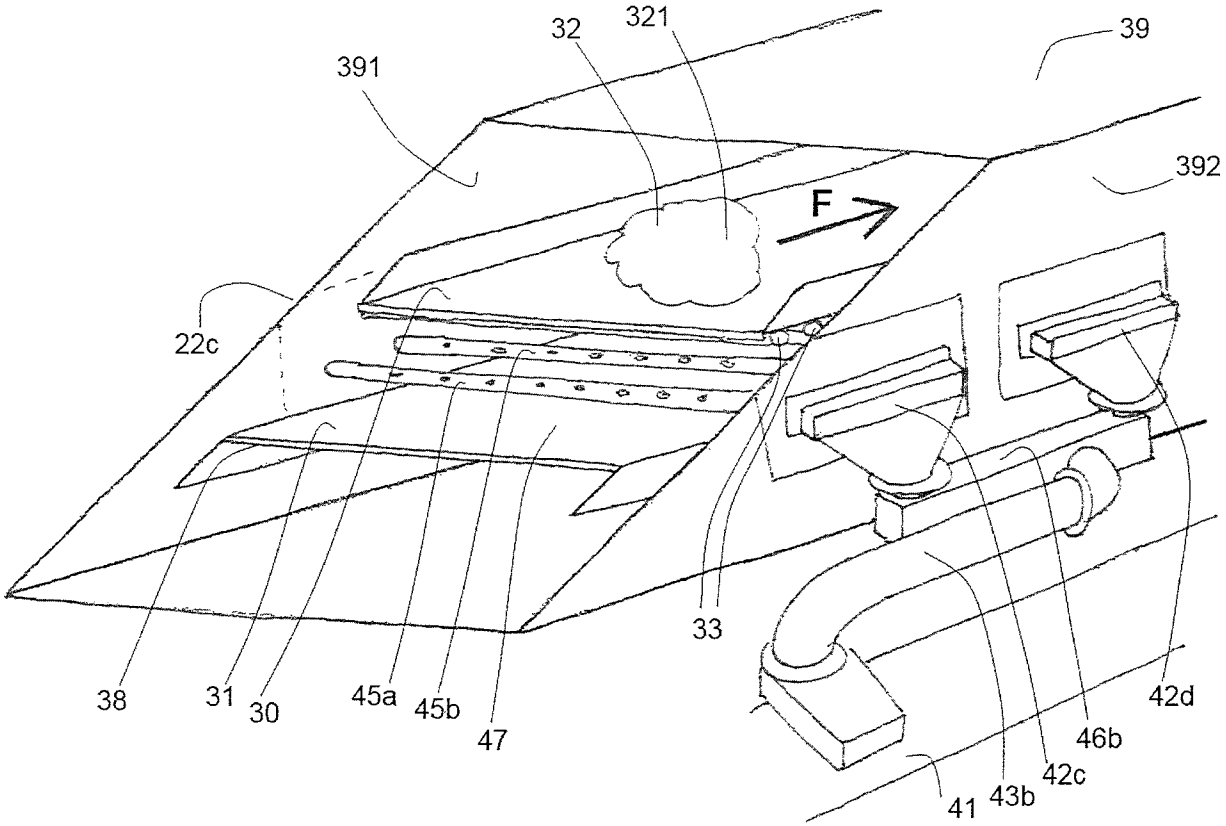
FIG. 2 shows a section drawing of a conveying device according to the invention, in perspective view.

As shown in FIG. 2, the conveying device comprises a conveyor belt 38 which, in the embodiment shown, is in the form of an endless conveyor belt which is guided on support rollers 33 and forms a conveying strand 30—on the conveying surface 37 of which the solid residues 32, that specifically are present in the form of clinker 321, are received and are conveyed in the conveying direction F—and a return strand 31.

According to the embodiment shown in FIG. 1, the conveying device runs horizontally in a first section, to which there connects a second section running diagonally upward and in which the cooling of the clinker 321 takes place.

In the specific embodiment shown in FIG. 1, coolant is introduced via a coolant supply 40 under the conveying surface 37 of the conveyor belt 38. The coolant supply 40 comprises, in principle, a coolant supply distribution pipe 41 which is connected to a coolant compressor 44 and via which the coolant is distributed into coolant supply pipes 43*a* to 43*d* which, in each case possibly, as shown in particular in FIG. 2, lead via a coupling pipe to a corresponding coolant inlet 42*a* to 42*h*.

At least part of the coolant heated by contact with the conveyor belt 38 is extracted through a coolant evacuation. The coolant evacuation comprises, in principle, coolant outlets via which coolant is extracted in each case via coolant evacuation pipes assigned to a coolant outlet. The coolant evacuation pipes open into a coolant evacuation collecting pipe.

It is of course also conceivable to choose a different number of coolant inlets and outlets, to choose a different geometry of the coolant supply and evacuation and a different arrangement thereof along the conveying device.

The solid body outlet 17 connects at the end, as viewed in the conveying direction F, of the conveyor belt 38, and in the embodiment shown is in the form of a discard chute into which the cooled clinker 321 is discarded.

The cooling, brought about according to the invention in the conveying device, and corresponding coolant supplies and coolant evacuations, are further illustrated with reference to FIG. 2.

As shown in the section drawing according to FIG. 2, the conveying device 1 has an elongate housing 39, coolant inlets, of which only two coolant inlets 42*c* and 42*d* are shown, coolant outlets, of which only the coolant outlet 22*c* is partially shown, and coolant supply nozzle pipes 45*a* to 45*d*.

The conveying strand 30 and the return strand 31 of the conveyor belt 38 form a loop which, together with the lateral side walls 391 and 392 of the housing 39, encloses a space 47. Coolant is supplied to the coolant supply nozzle pipes 45*a* to 45*d* via corresponding coolant supply pipes, for example 43*b*. Via these coolant supply nozzle pipes, the coolant is introduced into the space 47, on that side of the conveyor belt 38 oriented away from the conveying surface 37.

The coolant supply nozzle pipes shown in section in FIG. 2 are generally oriented at right angles to the side wall and, in this figure, are reproduced in a slightly distorted perspective for the sake of clarity.

Figure 3:
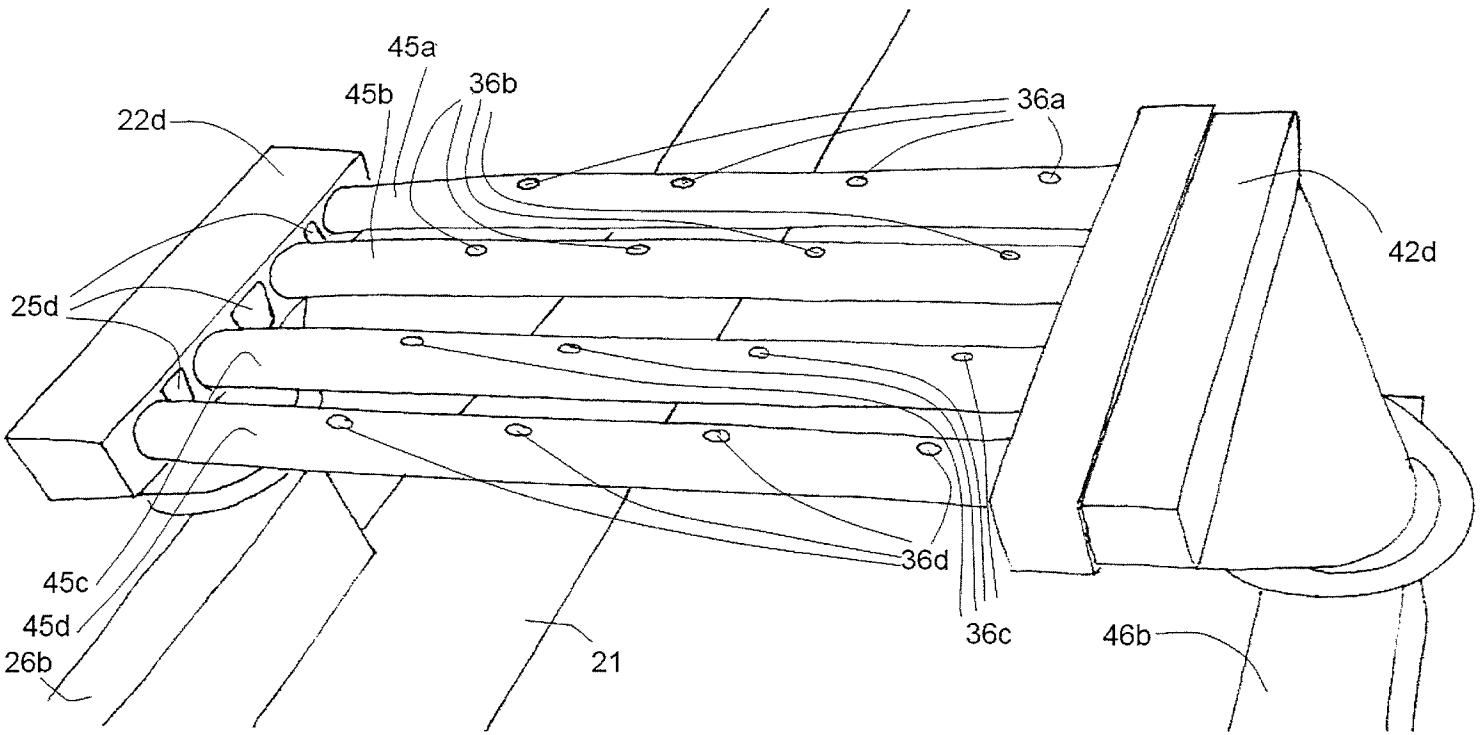
FIG. 3 shows a detail view of part of a conveying device according to the invention, without the housing, for injecting and simultaneously evacuating coolant under the conveying surface.

Openings on the coolant outlets, such as the coolant outlet 22*d* with openings 25*d* shown in FIG. 3, serve to evacuate, to the coolant evacuation collecting pipe 21, at least part of the coolant heated by contact with the conveyor belt 38. The purely exemplary representation according to FIG. 3 shows a supply coupling pipe 46*b* which is connected, via a coolant inlet 42*d*, to four coolant supply nozzle pipes 45*a* to 45*d*, via which air is introduced on that side of the conveyor belt oriented away from the conveying surface. In the specifically shown embodiment, the coolant supply nozzle pipes 45*a* to 45*d* are closed at their ends oriented away from the coolant inlet 42*d* and have, in their uppermost region, in each case four nozzle pipe openings 36*a* to 36*d*, via which the coolant is introduced in a distributed manner over the entire width of the conveyor belt 38.

At least part of the coolant heated by contact with the conveyor belt 38 is evacuated, by means of the openings 25*d* on the coolant outlet 22*d*, to the coolant evacuation collecting pipe 21.

It is of course also possible to choose a different arrangement, cross section geometry and number of the coolant supply nozzle pipes and of the openings. It is also conceivable that the coolant supply nozzle pipes do not cover the entire width of the conveyor belt. In another embodiment, the coolant supply pipes are not connected to coolant supply nozzle pipes but merely open, via openings at the inlets, into the space 47 and thus introduce the coolant.

Figure 4:
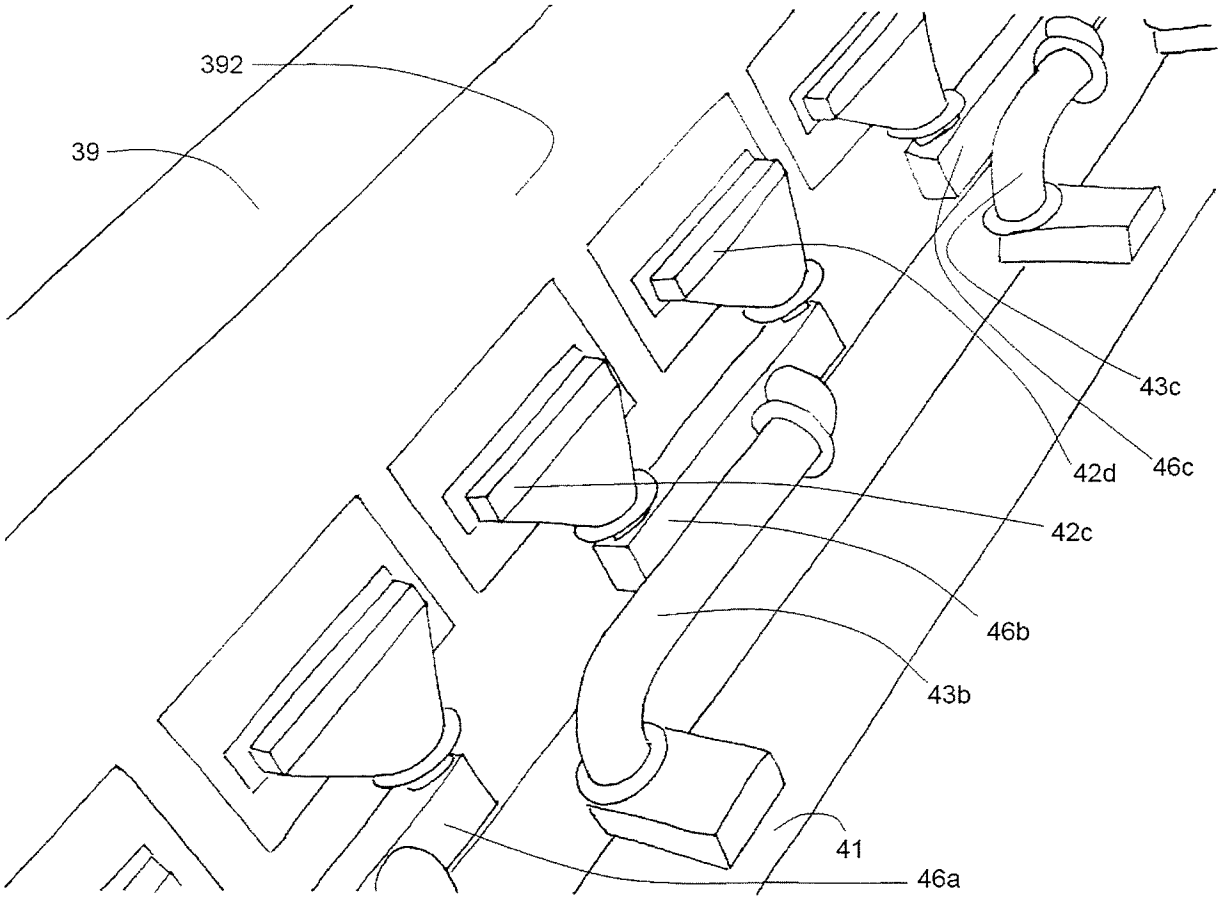
FIG. 4 shows a detail view of part of a conveying device according to the invention, corresponding to FIG. 3, with the housing.

FIG. 4 represents a specific example of an air supply and corresponds to FIG. 3 with the housing: two coolant inlets 42*c* and 42*d*, arranged in the side wall 392, are connected to a coolant supply pipe 43*b* via a supply coupling pipe 46*b*. This construction unit is repeated four times in the embodiment of FIG. 1; they are in each case connected to the same coolant supply distribution pipe 41, via which a coolant compressor 44 feeds the coolant into the space 47 under the conveying strand.

LIST OF REFERENCE SIGNS

1 conveying device
2 combustion chamber
4 waste supply
6 waste chute
10 combustion grate
11 primary air supply
12*a*-12*d* funnel neck
14*a*-14*d* under-grate air chamber
15 coarse clinker discard chute
16 primary air supply line
17 solid residue outlet
20 coolant evacuation
21 coolant evacuation collecting pipe
22*a*-22*h* coolant outlet
23*a*-23*d* coolant evacuation pipe
25*d* coolant outlet opening
26*b* evacuation coupling pipe
30 conveying strand
31 return strand
32, 321 solid residues, clinker
33 (support) roller of the conveyor belt
36*a*-36*d* nozzle pipe opening
37 conveying surface
38 conveyor belt
39 housing of the conveying device
391, 392 side wall of the housing
40 coolant supply
41 coolant supply distribution pipe
42*a*-42*h* coolant inlet
43*a*-43*d* coolant supply pipe
44 coolant compressor
45*a*-45*d* coolant supply nozzle pipe
46*a*-46*d* supply coupling pipe
47 space
F: conveying direction

The invention claimed is:

1. A conveying device, comprising:

a conveyor belt with a conveying surface for conveying solid residues; and means for cooling the solid residues comprising a coolant supply for introducing a gaseous coolant and a coolant evacuation for extracting at least part of the coolant heated by the solid residues, wherein:

the conveyor belt is essentially impermeable to the coolant, the conveyor belt is an endless conveyor belt that is guided around at least two rollers and forms a loop with a conveying strand and a return strand, the loop together with laterally arranged side walls enclosing a space to which are assigned the coolant supply and the coolant evacuation, the space between the conveying strand and the return strand is divided with a wall running essentially parallel to a plane of the conveying strand so as to form an interspace between the conveying strand and the wall, the coolant supply and the coolant evacuation being arranged in the interspace or being connected to the interspace, and the coolant supply and the coolant evacuation are configured such that the coolant is in contact only with a side of the conveyor belt oriented away from the conveying surface.

2. The conveying device as claimed in claim 1, wherein:

the coolant supply comprises coolant supply pipes that are connected, via a side wall, to the space below the conveying strand and via which the coolant can be introduced on the side of the conveyor belt oriented away from the conveying surface, and the coolant evacuation comprises coolant evacuation pipes that are connected via a side wall to the space below the conveying strand and by means of which at least part of the coolant heated by contact with the conveyor belt is extracted.

3. The conveying device as claimed in claim 2, wherein coolant supply nozzle pipes connected to the coolant supply pipes have nozzle pipe openings in their uppermost region.

4. The conveying device as claimed in claim 1, wherein the space between the conveying strand and the return strand is divided into at least two compartments in the conveying direction, in each case at least one valve for controlling quantity of the coolant to be introduced being (i) assigned to the coolant supply and/or evacuation assigned to the different compartments or (ii) connected to the different compartments.

5. The conveying device as claimed in claim 1, wherein the coolant supply comprises gas nozzles whose openings are arranged at least in part at a distance of less than 30 cm.

6. A waste combustion plant comprising a conveying device, the conveying device comprising:

a conveyor belt with a conveying surface for conveying solid residues; and means for cooling the solid residues comprising a coolant supply for introducing a gaseous coolant and a coolant evacuation for extracting at least part of the coolant heated by the solid residues, wherein:

the conveyor belt is essentially impermeable to the coolant, the conveyor belt is an endless conveyor belt that is guided around at least two rollers and forms a loop with a conveying strand and a return strand, the loop together with laterally arranged side walls enclosing a space to which are assigned the coolant supply and the coolant evacuation, the space between the conveying strand and the return strand is divided with a wall running essentially parallel to a plane of the conveying strand so as to form an interspace between the conveying strand and the wall, the coolant supply and the coolant evacuation being arranged in the interspace or being connected to the interspace, and the coolant supply and the coolant evacuation are configured such that the coolant is in contact only with a side of the conveyor belt oriented away from the conveying surface.

7. A method for cooling solid residues of a combustion process, the method comprising:

depositing the solid residues onto a conveying surface of a conveyor belt of a conveying device; and conveying the solid residues in the direction of a solid residue outlet, wherein:

during the conveying heat is transferred from the solid residues to a gaseous coolant introduced by way of a coolant supply, the conveyor belt is acted upon by the coolant only on its side oriented away from the conveying surface, the conveyor belt is essentially impermeable to the coolant, the conveyor belt is an endless conveyor belt that is guided around at least two rollers and forms a loop with a conveying strand and a return strand, the loop together with laterally arranged side walls enclosing a space to which are assigned the coolant supply and a coolant evacuation, the space between the conveying strand and the return strand is divided with a wall running essentially parallel to a plane of the conveying strand so as to form an interspace between the conveying strand and the wall, the coolant supply and the coolant evacuation being arranged in the interspace or being connected to the interspace, and at least part of the coolant heated by contact with the conveyor belt is extracted on the side oriented away from the conveying surface by way of the coolant evacuation.

8. The method as claimed in claim 7, wherein the temperature of the solid residues deposited onto the conveying surface is in a range from 200° C. to 500° C.

9. The method as claimed in claim 7, wherein the solid residues are cooled, while being conveyed to the solid residue outlet, to below 150° C.

10. The method as claimed in claim 7, wherein the heated coolant is used as a heating medium after extraction.

11. The method as claimed in claim 7, wherein the coolant is air.

12. The method as claimed in claim 7, wherein, for cooling the solid residues, the coolant is simply circulated in a space that is separate from the space in which the solid residues are arranged.

13. The method as claimed in claim 7, wherein the conveyor belt is acted upon by the coolant via gas nozzle openings that are arranged, at least in part, at a distance of less than 30 cm.

* * * * *